US006501494B2

(12) United States Patent
Kubelik

(10) Patent No.: US 6,501,494 B2
(45) Date of Patent: Dec. 31, 2002

(54) THIN FILM PRINTHEAD WITH LAYERED DIELECTRIC

(75) Inventor: Igor Kubelik, Mississauga (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/852,426

(22) Filed: May 9, 2001

(65) Prior Publication Data

US 2002/0167579 A1 Nov. 14, 2002

(51) Int. Cl.[7] ..... B41J 2/415
(52) U.S. Cl. ..... 347/127
(58) Field of Search ..... 347/150, 141, 347/127

(56) References Cited

U.S. PATENT DOCUMENTS

| | | | | |
|---|---|---|---|---|
| 4,155,093 A | | 5/1979 | Fotland et al. | |
| 4,160,257 A | | 7/1979 | Carrish | |
| 4,267,556 A | * | 5/1981 | Fotland et al. | 347/127 |
| 4,679,060 A | | 7/1987 | McCallum et al. | |
| 4,683,482 A | * | 7/1987 | Inaba et al. | 347/127 |
| 4,745,421 A | | 5/1988 | McCallum et al. | |
| 4,819,013 A | | 4/1989 | Beaudet | |
| 4,891,656 A | | 1/1990 | Kubelik | |
| 4,926,197 A | | 5/1990 | Childers et al. | |
| 4,956,670 A | * | 9/1990 | Masuda et al. | 347/127 |
| 4,999,653 A | | 3/1991 | McCallum | |
| 5,008,689 A | | 4/1991 | Pan et al. | |
| 5,014,076 A | * | 5/1991 | Caley et al. | 347/127 |
| 5,030,975 A | | 7/1991 | McCallum et al. | |
| 5,068,961 A | * | 12/1991 | Nishikawa | 347/127 |
| 5,159,358 A | | 10/1992 | Kubelik | |
| 5,601,684 A | * | 2/1997 | Shiga | |
| 6,377,289 B1 | * | 4/2002 | Philebrown et al. | 347/127 |

FOREIGN PATENT DOCUMENTS

JP 5-124254 * 5/1993

OTHER PUBLICATIONS

Philebrown, Peter "Electron Beam Imaging Enhancement through the application of Thin Film Technology", *IS&T's 49th Annual Conference*, Nov. 1997.

* cited by examiner

*Primary Examiner*—Susan S. Y. Lee
(74) *Attorney, Agent, or Firm*—Fay, Sharpe, Fagan, Minnich & McKee, LLP

(57) ABSTRACT

A printhead is disclosed having a dielectric layer composition with a relatively small capacitance while also being substantially plasma erosion resistant. In accordance with one example embodiment of the present invention, the printhead has at least a first electrode layer and at least a second electrode layer. A dielectric composition constructed of at least two dielectric layers of different dielectric materials insulates the first and second electrode layers with respect to each other.

18 Claims, 2 Drawing Sheets

THIN FILM PRINTHEAD WITH LAYERED DIELECTRIC

FIELD OF THE INVENTION

The invention relates to image forming systems, and more particularly relates to printheads having multiple dielectric layers.

BACKGROUND OF THE INVENTION

Different printhead technologies in use today in image forming systems create and reproduce images in different ways. Some of these technologies include a process of charging a surface of an image-receiving member. The term image-receiving member includes any suitable structure capable of obtaining and retaining the charged latent image. The image-receiving member can be a drum, a flat or curved dielectric surface, or a flexible dielectric belt, which moves along a predetermined path. The image-receiving member can also comprise liquid crystal, phosphor screen, or similar display panel in which the latent charge image results in a visible image. The image-receiving member typically includes on an exterior surface a material such as a dielectric layer that lends itself to receiving the latent charge image. A number of organic and inorganic materials are suitable for the dielectric layer of the image-receiving member. The suitable materials include glass enamel, anodized and flame or plasma sprayed high-density aluminum oxide, and plastic, including polyamides, nylons, and other tough thermoplastic or thermoset resins, among other materials.

The image-receiving member moves past an image forming device, such as a printhead, which produces streams of accelerated electrons as primary charge carriers. The electrons reach the drum, landing in the form of a latent charge image. The latent charge image then receives a developer material, to develop the image, and the image is then transferred and fused to a medium, such as a sheet of paper, to form a printed document.

The printhead most often includes a film having a multi-electrode structure that defines an array of charge-generating sites. Each of the charge-generating sites, when the electrodes are actuated, generates and directs toward the drum a stream of charge carriers, e.g., electrons, to form a pointwise accumulation of charge on the drum that constitutes the latent image.

A representative printhead generally includes a first collection of drive electrodes, e.g., RF-line electrodes, oriented in a first direction across the direction of printing. A second collection of control electrodes, e.g., finger electrodes, oriented transversely to the drive electrodes, forms spatially separated cross points or intersections with the drive electrodes to form the charge-generating sites, at which charges originate. The electrodes themselves are actually separated and electrically insulated from each other by at least one dielectric layer or composition.

The printhead can also include a second insulating layer and a third electrode structure, often identified as a screen electrode. The second insulating layer couples to the finger electrodes and the screen electrodes. The screen electrodes have a plurality of passages in alignment with the charge-generating sites, to allow the streams of charge carriers to pass through. The screen electrode can be a single conductive sheet having an aperture aligned over each charge-generating site. The polarity of the charge carriers passing through the passages, or apertures, depends on the voltage difference applied to the finger and screen electrodes. The polarity of particles accumulated on the drum to create latent image is determined by the voltage difference between the screen electrode and the drum surface. The charged particles of appropriate polarity are inhibited from passing through the aperture, depending upon the sign of the charge, so that the printhead emits either positive or negative charge carriers, depending on its electrode operating potentials.

A disadvantage of conventional thin film printheads is a significant rate of dielectric erosion caused by reactive ion bombardment of the dielectric surface. The erosion rate of the dielectric is proportional to, among other factors, the sputtering yield, impinging ion fluency, and angle of ion incidence. A known solution for minimizing sputtering yield is to utilize a high density, hard and relatively defect-free, dielectric material. To decrease the impinging ion fluency, a reduction of the dielectric layer capacitance is required.

The particular dielectric material utilized has proven a significant factor in erosion resistance. The erosion rate of aluminum oxide, for example, is substantially less than that of silicon oxide. However, alumina permittivity is more than double the value of silicon dioxide. Therefore, a single aluminum oxide layer used for thin film printhead structures results in an increased capacitance. The high capacitance of the dielectric layer, in turn, leads to a rise of the ion bombardment density and to an increase in the dielectric erosion rate. Furthermore, a high printhead capacitance reduces the printing speed and/or the print resolution.

SUMMARY OF THE INVENTION

There exists in the art a need for a thin film printhead having a dielectric layer composition with a relatively small capacitance while also being substantially plasma erosion resistant. The present invention is directed toward further solutions in this art.

A printhead, in accordance with one example embodiment of the present invention, has at least a first electrode layer (e.g., RF-line electrodes) and at least a second electrode layer (e.g., finger electrodes). A dielectric composition constructed of at least two dielectric layers of different dielectric materials insulates the first and second electrode layers with respect to each other. Those of ordinary skill in the art will readily recognize that additional layers can combine to form the printhead. For sake of simplicity, we discuss in detail herein the foregoing three printhead components.

The printhead, according to a further aspect of the present invention, includes an RF-line electrode layer forming the first electrode layer, and a finger electrode layer forming the second electrode layer. The RF-line electrode layer and the finger electrode layer form intersections, defining charge-generating sites for emitting charge carriers. The dielectric composition electrically insulates the RF-line electrode layer from the finger electrode layer by the dielectric composition constructed of at least two dielectric layers of different materials.

The dielectric composition, in accordance with another aspect of the present invention, can have a plurality of dielectric layers utilizing different dielectric materials. These dielectric materials can be, for example, any one of silicon dioxide, aluminum oxide, silicon nitride, magnesium oxide, and boron nitride, among other materials not specified herein. Each of the layers within an individual dielectric composition is comprised of multiple different layers of dielectric material separating the finger and RF-line electrodes.

There are at least two dielectric materials, according to another aspect of the present invention, forming multiple layers in the dielectric composition. The dielectric composition can be formed of any number of materials and layers while still fitting within structural limitations for a printhead within an image forming system. There can be an equal number of dielectric materials forming such layers, or alternatively a lesser number of dielectric materials. The dielectric materials can alternate in arrangement to form the plurality of dielectric layers when there are more dielectric layers than dielectric materials utilized.

At least one dielectric layer, according to still another aspect of the present invention, contains impurities. These impurities can be chosen, for example, from a group consisting of carbon, boron, tungsten, and thallium, among other impurities not specified herein.

BRIEF DESCRIPTION OF THE DRAWINGS

The aforementioned features and advantages, and other features and aspects of the present invention, will become better understood with regard to the following description and accompanying drawings, wherein.

DETAILED DESCRIPTION OF THE INVENTION

The present invention generally relates to a printhead mounted within an image forming system. A characteristic of the printhead is that there exists at least one dielectric composition within the printhead having at least two different dielectric layers made of at least two different dielectric materials. The use of a layered structure allows for different combinations of layer thickness and materials. A dielectric material with low dielectric constant, for example, can be utilized in a first layer, such as silicon dioxide, and does not necessarily need to be of a high quality. The second layer then can represent a relatively small portion of the dielectric composition with a highly plasma erosion resistant material, such as aluminum oxide. This unique combination of different dielectric materials in a plurality of layers results in a low capacitance printhead with suppressed erosion. Furthermore, variations of the combination of dielectric layers and materials enable tuning of the total effective dielectric composition to minimize plasma-based erosion while also minimizing printhead capacitance.

FIGS. 1 through 4 illustrate example embodiments of a printhead according to the present invention. Although the present invention will be described with reference to the example embodiments illustrated in the figures, it should be understood that the present invention can be embodied in many alternative forms. One of ordinary skill in the art will appreciate different ways to alter the parameters of the embodiments disclosed, such as the size, shape, or type of elements or materials, in a manner still in keeping with the spirit and scope of the present invention.

The image forming system illustrated is shown solely for the purpose of providing a general structure into which the present invention can fit. One skilled in the art will understand that other image forming systems or charge transfer apparat can be utilized in combination with different embodiments of the present invention, without departing from the spirit and scope of the invention disclosed herein. Image forming systems, for example, can include a collection of different technologies and image forming or reproducing systems that are adapted to capture and/or store image data associated with a particular object, such as a document, and reproduce, form, or produce an image.

Figure 1:
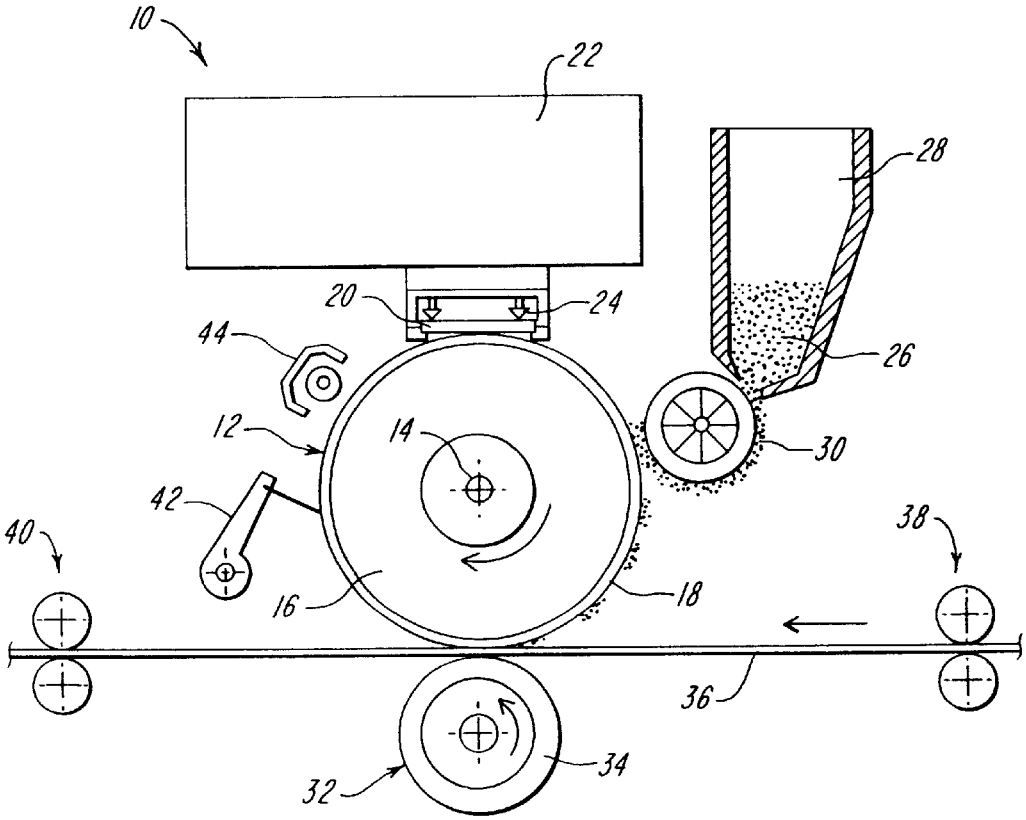
FIG. 1 is a diagrammatic illustration of an example image forming system suitable for use with the printhead of the present invention.

FIG. 1 illustrates an electron beam image forming system 10 having an image-receiving member, such as a drum 12, rotatably mounted about an axis 14. The drum 12 incorporates an electrically conductive core 16 that is coated with a dielectric surface 18. An alternative structure not shown provides a belt supporting the dielectric layer and circulating around several wheel mechanisms.

The dielectric surface 18 receives a charged image from a printhead 20. Electrical connectors 24 connect a controller 22, which drives the printhead 20 as desired. As the drum 12 rotates in the direction of the arrow shown around the axis 14, charge from proper charge-generating sites inside the printhead 20 is accelerated toward the drum dielectric surface 18 to create a latent image on the outer surface of the drum 12. A toner hopper 28 feeds toner particles 26 through a feeder 30 to bring the particles 26 into contact with the drum dielectric surface 18. The toner particles 26 electrostatically adhere to the charged areas on the dielectric surface 18, developing the charged image into a toner image. The rotating drum 12 then carries the toner image towards a nip formed with a pressure roller 32. The pressure roller 32 has an outer layer 34 positioned in the path of a receptor, such as a paper sheet 36. The paper sheet 36 enters between a pair of feed rollers 38. The pressure in the nip is sufficient to cause the toner particles 26 to transfer and permanently affix to the paper sheet 36. The paper sheet 36 continues through and exits between a pair of output rollers 40. After passing through the nip between the drum 12 and the pressure roller 32, a scraper blade assembly 42 removes any toner particles 26 that may remain on the dielectric surface 18. A charge eraser 44 positioned between the scrapper blade assembly 42 and the printhead 20 removes any residual charge remaining on the dielectric surface 18. The process can then repeat for a next image.

A printhead configuration generally known to those skilled in the art is most common in EBI printing technologies. The printhead includes a first electrode layer having a plurality of driving electrodes, called RF-line electrodes, sealed and electrically isolated from a second electrode layer by at least one dielectric layer or composition. The second electrode layer is made of a set of control electrodes, called finger electrodes, which cross the plurality of RF-line electrodes, creating a matrix of plasma generating sites from which the charge is extracted.

The printhead can also include a second insulating layer and a third screen electrode structure. The second insulating layer couples to the finger electrodes and the screen electrode. The screen electrode, typically in the form of a conductive layer, has a plurality of apertures or passages positioned in alignment with the charge-generating sites, to allow the stream of charge carriers to pass through.

The polarity of the charge carriers passing through the passages depends on the voltage difference applied to the finger and screen electrodes. The polarity of the particles accumulated on the drum to create the latent image is determined by the voltage difference between the screen electrode and the drum surface 18. The charged particles of appropriate polarity are inhibited from passing through the aperture, depending upon the charge polarity, so that the printhead emits either positive or negative charge carriers, depending on its electrode operating potentials. Those of ordinary skill in the art will readily recognize that additional layers can combine to form the printhead.

Figure 2:
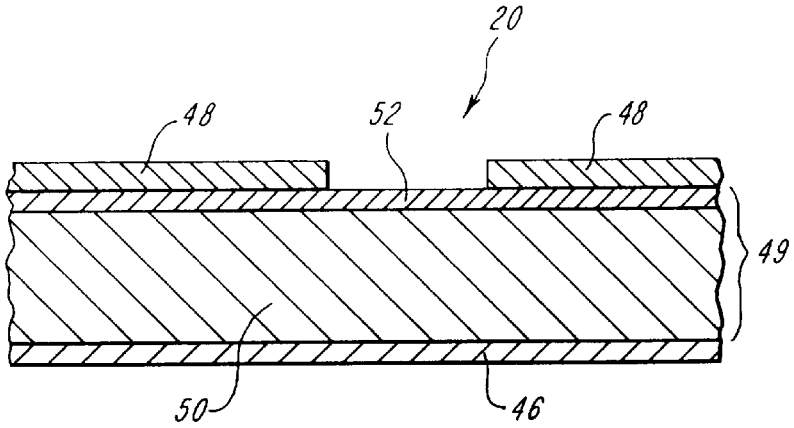
FIG. 2 is a diagrammatic cross-section of a single charge-generating site of the printhead according to the teachings of the present invention.

FIG. 2 illustrates a schematic cross-section of a single charge generating site of the printhead 20 according to the teachings of the present invention. An RF-line electrode 46 is spaced and electrically isolated from a finger electrode 48 by a dielectric composition 49. The dielectric composition is formed of a first dielectric layer 50, which is coupled with the RF-line electrode 46 and mounted together with a second dielectric layer 52. The second dielectric layer 52 further couples with a finger electrode layer 48.

The material that comprises the first dielectric layer 50 is different from the material that comprises the second dielectric layer 52. The bottom layer (the first dielectric layer 50), for example, which forms a major portion of the entire dielectric composition 49, is made of a dielectric material with a small dielectric constant. The top layer (second dielectric layer 52), in contrast, has material characteristics of high quality and high density dielectric, with minimum sputtering yield as well as minimum affinity to the reactive plasma species. While the second dielectric layer 52 is highly resistive to degradation resulting from contact with plasma formed during the printing process, the first layer 50 has a low capacitance. The different combinations of the dielectric layers and the different materials enables a fine-tuning of the overall effective dielectric thickness to minimize damage or degradation caused by ion bombardment. A factor to consider is the number of impinging ions during air breakdown, which is linearly proportional to the electrode capacitance of the finger electrode 48 and the RF-line electrode 46. Therefore, the resulting printhead 20, experiences a longer life an allows for fast and high quality printing.

Figure 3:
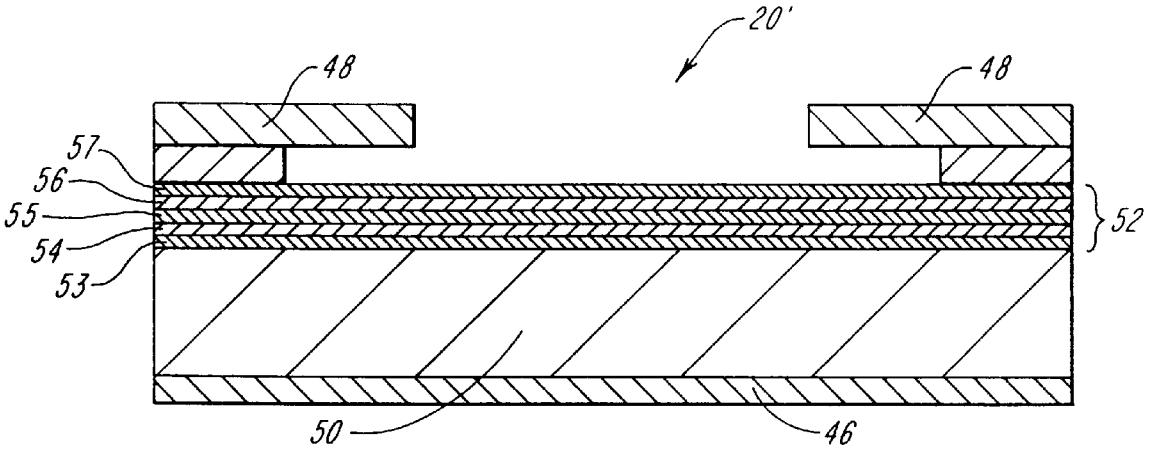
FIG. 3 is a diagrammatic cross-section of an alternate embodiment of the charge-generating site of the printhead according to the teachings of the present invention.

FIG. 3 shows a diagrammatic cross-section of a charge generating site 20' of a printhead where a basic dielectric layer of low permittivity 50 couples with a top layer of a dielectric 52 having layered structure made of different dielectric materials. In the illustrated embodiment, five layers 53, 54, 55, 56 and 57 with various properties form the top dielectric layer 52. Materials used in neighboring layers within the top dielectric layer 52 differ in, e.g., atomic weights, bonding energies, or angular erosion characteristics. For example, in the case of only two materials used, layers 53, 55, and 57 are made of the first material while the second material forms layers 54 and 56. In the case of five materials used, all layers 53, 54, 55, 56, and 57 forming the top dielectric layer are different. If angles of the maximum erosion of two neighboring layers significantly differ, the resulting rate of erosion is greatly reduced. The number of layers, their thickness and arrangement, as well as the materials utilized in forming the layers can vary substantially. The different layer combination in the top dielectric contributes further to the ability to tune the total effective dielectric thickness to minimize ion bombardment erosion, as well as the overall printhead capacitance.

Figure 4:
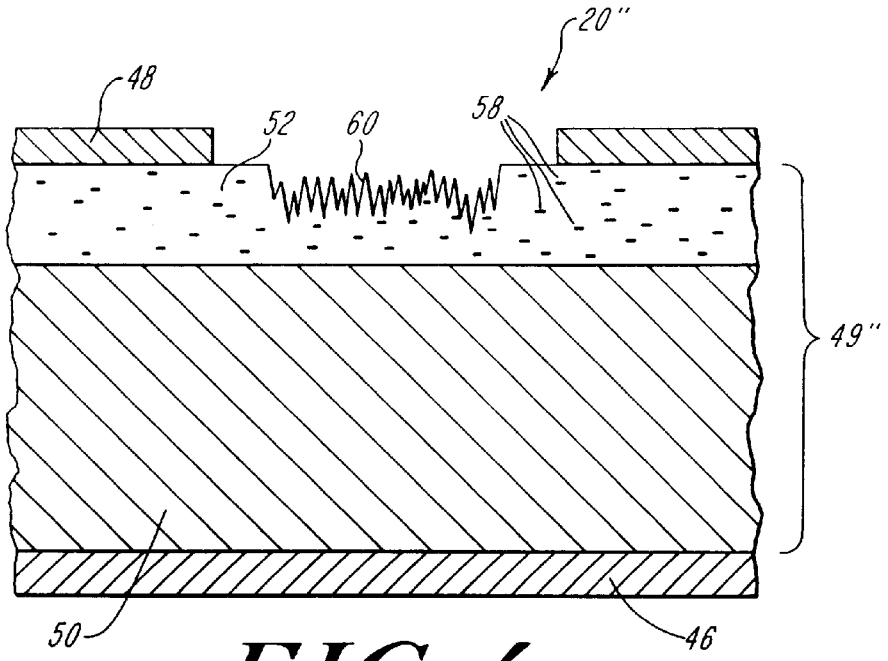
FIG. 4 is a diagrammatic cross-section of another embodiment of the printhead charge generating site according to the teachings of the present invention.

FIG. 4 illustrates yet another dielectric composition 49" for a charge generating site 20" of a printhead. RF-line electrode layer 46 bonds with the first dielectric layer 50. The first dielectric layer 50 then bonds with the second dielectric layer 52, which in turn bonds with the finger electrode layer 48. The material that comprises the first dielectric layer 50 is different from the material that comprises the second dielectric layer 52, and has a relatively low dielectric constant. The material does not need to be plasma erosion resistive. The second dielectric layer 52, in contrast, is made of material with relatively good plasma erosion resistance. The second dielectric layer 52 is doped with a plurality of impurities 58.

The seeding of the second dielectric layer 52 with impurities 58 has several effects. Impurity atoms with very low sputtering yield cause formation of a cone structure in the surface of the dielectric 52 due to selective erosion by the plasma, which results in the peaks and valleys 60. Speed of the dielectric erosion gradually decreases to the level of the impurity atom sputtering. Further, impurity atoms can enhance the bonding energy of the basic material and reduce the chemical reactivity of impinging ions. The resulting charge-generating site 20" of the printhead, therefore, experiences a longer life because its dielectric layers do not decompose as rapidly as those printheads having a less resistive dielectric layer exposed to plasma species.

A variety of different dielectric materials can form any of the dielectric layers of the present invention. Materials, for example, that differ in their angular erosion characteristics, such as silicon dioxide, aluminum oxide, magnesium oxide, and boron nitride, are all valid examples of potential dielectric materials. These materials can form the dielectric composition in different combinations. Further additional dielectric materials can be utilized to modify the characteristics of the dielectric compositions. The impurities in the dielectric layer can be different materials such as carbon, boron, tungsten, and thallium, or with impurities inhibiting chemically enhanced sputtering.

The layered dielectric structure allows for the use of low permittivity dielectric materials in the bottom most layer, such as silicon dioxide. The top most layer can be highly plasma resistant to substantially hinder erosion of the dielectric layer. This combination is relatively inexpensive while quite effective. A substitution of the top layer with a multilayer structure further reduces-erosion. Alternating materials are unlike in their angular erosion characteristics. The difference in angular erosion characteristics of two neighboring layers of dielectric greatly reduces erosion. The additional use of certain impurities seeded in the dielectric layers additionally reduces erosion levels due to resulting cone structure formations.

Numerous modifications and alternative embodiments of the invention will be apparent to those skilled in the art in view of the foregoing description. Accordingly, this description is to be construed as illustrative only and is for the purpose of teaching those skilled in the art the best mode for carrying out the invention. Details of the structure may vary substantially without departing from the spirit of the invention, and exclusive use of all modifications that come within the scope of the appended claims is reserved. It is intended that the invention be limited only to the extent required by the appended claims and the applicable rules of law.

What is claimed is:

1. A printhead, comprising:

at least a first electrode layer;

at least a second electrode layer; and said first and second electrode layers being electrically insulated with respect to each other by a dielectric composition having at least two layers formed of different dielectric materials.

2. The printhead of claim 1, wherein said first electrode layer and said second electrode layer are each one of an RF-line electrode layer and a finger electrode layer.

3. The printhead of claim 1, wherein said first electrode layer and said second electrode layer form crossing points defining charge-generating sites for emitting charge carriers.

4. The printhead of claim 1, wherein said dielectric composition comprises a plurality of dielectric layers formed of different dielectric materials.

5. The printhead of claim 4, wherein one or more of said plurality of layers is formed of a material selected from a group consisting of silicon dioxide, aluminum oxide, silicon nitride, magnesium oxide, and boron nitride.

6. The printhead of claim 4, wherein said dielectric composition comprises multiple alternating layers formed of different materials.

7. The printhead of claim 4, wherein said dielectric composition comprises a first layer formed of a first dielectric material and a second layer, said second layer includes a plurality of sub-layers formed of at least two different dielectric materials.

8. The printhead of claim 4, wherein said dielectric composition comprises a plurality of first layers formed of a first dielectric material and a plurality of second layers formed of a second dielectric material, wherein said first and second layers are alternately stacked together to form said dielectric composition.

9. The printhead of claim 4, wherein at least one of said dielectric layers of said dielectric composition includes impurities.

10. The printhead of claim 9, wherein said impurities are selected from a group consisting of carbon, boron, tungsten, and thallium.

11. In an image forming system, a printhead, comprising:

an RF-line electrode layer;

a finger electrode layer forming crossing points with said RF-line electrode and defining charge-generating sites for emitting charge carriers; and a dielectric composition electrically insulating said RF-line electrode layer with respect to said finger electrode layer, said dielectric composition being constructed of at least two layers formed of different materials.

12. The image forming system of claim 11, wherein said dielectric composition comprises a plurality of dielectric layers formed of different dielectric materials.

13. The image forming system of claim 11, wherein one or more of said plurality of layers is formed of a material selected from a group consisting of silicon dioxide, aluminum oxide, silicon nitride, magnesium oxide, and boron nitride.

14. The image forming system of claim 11, wherein said dielectric composition comprises multiple alternating layers formed of different materials.

15. The image forming system of claim 11, wherein said dielectric composition comprises a first layer formed of a first dielectric material and a second layer, said second layer includes a plurality of sub-layers formed of at least two different dielectric materials.

16. The image forming system of claim 11, wherein said dielectric composition comprises a plurality of first layers formed of a first dielectric material and a plurality of second layers formed of a second dielectric material, wherein said first and second layers are alternately stacked together to form said dielectric composition.

17. The image forming system of claim 11, wherein at least one of said at least two layers of said dielectric composition includes impurities.

18. The image forming system of claim 17, wherein said impurities are selected from a group consisting of carbon, boron, tungsten, and thallium.

* * * * *